US005866836A

United States Patent [19]

Bergstrom

[11] Patent Number: 5,866,836

[45] Date of Patent: Feb. 2, 1999

[54] LOW FREQUENCY SOUND MONITORING SYSTEM FOR MUSICIANS

[76] Inventor: Scott Bergstrom, 7270 Pembroke Dr., Reno, Nev. 89502

[21] Appl. No.: 45,672

[22] Filed: Mar. 20, 1998

[51] Int. Cl.[6] ..... G10H 1/12

[52] U.S. Cl. ..... 84/736; 381/118; 381/152

[58] Field of Search ..... 84/736, 743; 381/56, 381/96, 118, 121, 152

[56] References Cited

U.S. PATENT DOCUMENTS

| | | | |
|---|---|---|---|
| 4,506,379 | 3/1985 | Komatsu . | |
| 4,641,345 | 2/1987 | Takahashi . | |
| 4,778,027 | 10/1988 | Taylor . | |
| 5,054,361 | 10/1991 | Usa | 84/743 X |
| 5,063,821 | 11/1991 | Battle | 84/723 |
| 5,618,178 | 4/1997 | Copperman et al. . | |

*Primary Examiner*—William M. Shoop, Jr.
*Assistant Examiner*—Jeffrey W. Donels
*Attorney, Agent, or Firm*—Limbach & Limbach L.L.P.

[57] ABSTRACT

A sound monitoring system includes a resonator platform comprised of musician support plate, a base plate, and at least one transducer. The musician support plate acts as a surface upon which the user may stand or sit. In response to high-frequency filtered and amplified electrical signals from a sound source, the transducer of the resonator platform imparts vibrational energy to the musician support plate, which in turn acts as a diaphragm to impart low frequency sounds to the musician by touch without generating appreciable audible energy. The base and musician support plates may have various geometric shapes and sizes, and are composed of materials suitable for transmitting vibrational energy.

7 Claims, 3 Drawing Sheets

LOW FREQUENCY SOUND MONITORING SYSTEM FOR MUSICIANS

BACKGROUND OF THE INVENTION

1. Field of the Invention

The present invention relates to a system for monitoring low frequency sounds, and more specifically to a sound monitoring system for musicians that translates electrical signals corresponding to low-frequency sounds into mechanical energy, allowing the musician to sense the intensity and duration of those sounds by touch.

2. Description of the Prior Art

Much of modern music is performed utilizing electronic amplification, whether out of necessity given the electronic nature of the musical instruments themselves, or in response to the high sound volumes demanded by today's listeners. Unfortunately, under circumstances of high amplification, the volume of performance sound can interfere with and overwhelm the ability of the musicians to monitor their performances.

For example, most live band performances include a drummer. The drummer is traditionally positioned behind the other players, thereby allowing the drummer to hear a blend, or "mix" of the total performance sound in order to maintain consistency. However, under high sound volume conditions, the drummer usually requires a stage monitoring speaker independent from speakers designed to project sound to the audience, to provide a controlled sound reference for himself and for the other performers. The stage monitor speakers generally need to be large in order to reproduce the desired "mix" at very high sound pressure levels. Most often, the bass drum and bass guitar are the loudest components of this "mix", and the stage monitor speakers must reproduce the full sound of the instruments in order to assist the drummer to work along with the other members of the band.

The relatively high amplification required by the stage monitoring speaker creates two serious problems. First, longer sound waves generated by the low frequency component of the stage monitoring speakers permeate, or "bleed", into microphones that are transmitting the performance sound to the listeners. Unwanted mixing of monitoring sound and performance sounds can occur at different times, due to the varying distances between the microphones and the stage monitor speakers.

As a result of the unwanted transmission of low frequency sound waves from the stage monitor speakers into the microphones, the phase coherence of any given sound wave is unpredictably distorted. This distortion occurs because of the additive effect of combining slightly different phases of sound caused by the various distances between the microphones and the stage monitor. This interaction between monitoring and performance sound can compromise both the overall performance mix and the monitor mix.

Bleeding of low frequency sound waves from the stage monitor into the microphones also reduces control over the performance sound mix. The sheer sound pressure level from the stage monitor, in particular the lowest frequency sound waves which produce most of the energy, degrade the quality of sound produced by the individual instruments. For example, as an overhead microphone is brought up in volume to reproduce the cymbals, it will also capture sound of the entire mix of instruments generated by the stage monitor. When this interaction occurs, the individual sound quality of the respective instruments is lost, and the quality of the overall mix declines.

A second problem associated with conventional sound monitoring relates to the range of sound frequencies associated with the various instruments. For example, the low sound frequencies of the bass drum and bass guitar referenced by the drummer are in the frequency range of thirty-to-eighty cycles. At thirty cycles, the corresponding sound wave is almost forty feet long. As the drummer is typically about three feet from the stage monitor, the forty foot wave cannot properly develop to allow the drummer to hear it well.

Unfortunately, many musicians increase the volume of the stage monitor in order to compensate for this disparity between sound wavelength and distance from the stage monitor. Resulting elevated sound volume causes excessive consumption of power and abuse to the speakers, and often prompts the surrounding band members to play louder. The compounded increase in sound volume can damage the drummer's hearing. Hearing loss is today a common and serious problem among musicians.

While problems associated with conventional stage monitoring is described above with reference to the drums, these same problems also affect other instruments. For example, the bass guitar and keyboard often produce low frequency notes during a performance. Again, because performers want to "feel", as well as hear the sounds generated, bass players and keyboard players may seek to amplify their instruments beyond levels optimum for the performance "mix".

There have been a number of attempts to overcome problems associated with unwanted contamination of performance sound by monitoring sound. For example, many musicians now utilize in-ear monitors. While effective, in-ear monitoring systems are quite expensive. Other than the high cost, the biggest drawback associated with in-ear monitors is an ability to accurately reproduce adequate low frequencies due to the limitations in the size of earpiece diaphragms. Thus, performers who utilize in-ear monitors often find that they miss the "feel" of the core rhythm elements—the bass and kick.

Finally, it is important to note that problems associated with the mixture of performance and monitoring sound are not necessarily limited to the concert hall. In the recording studio, many musicians maintain their headphones at sufficiently high volume that enough sound escapes to be detected by open studio microphones. Again, this unwanted mixing of monitoring and performance sound can seriously degrade the quality of the music produced.

Accordingly, it is desirable to utilize a stage monitoring system that permits performers to detect and monitor low frequency sounds without having to resort to large stage monitor speakers.

SUMMARY OF THE INVENTION

This invention relates to a system for sound monitoring that includes a resonator platform. Electromagnetic transducers in the resonator platform receive electronic signals corresponding to low frequency sounds, and translate these electronic signals into vibrational energy. The musician sits or stands upon the resonator platform, and senses this vibrational energy by touch. Use of the present invention avoids serious problems such as contamination of performance sound with monitoring sound, and damage to the hearing of musicians due to excessive monitoring sound volume.

DESCRIPTION OF THE INVENTION

The sound monitoring systems, resonator platforms, and methods of using in accordance with the present invention substantially eliminate problems associated with unwanted mixing of monitoring and performance sound. The present invention accomplishes this result by removing low frequency acoustic energy from the monitoring sound, imparting this energy to the musicians instead by touch.

1. Sound Monitoring System

Figure 1:
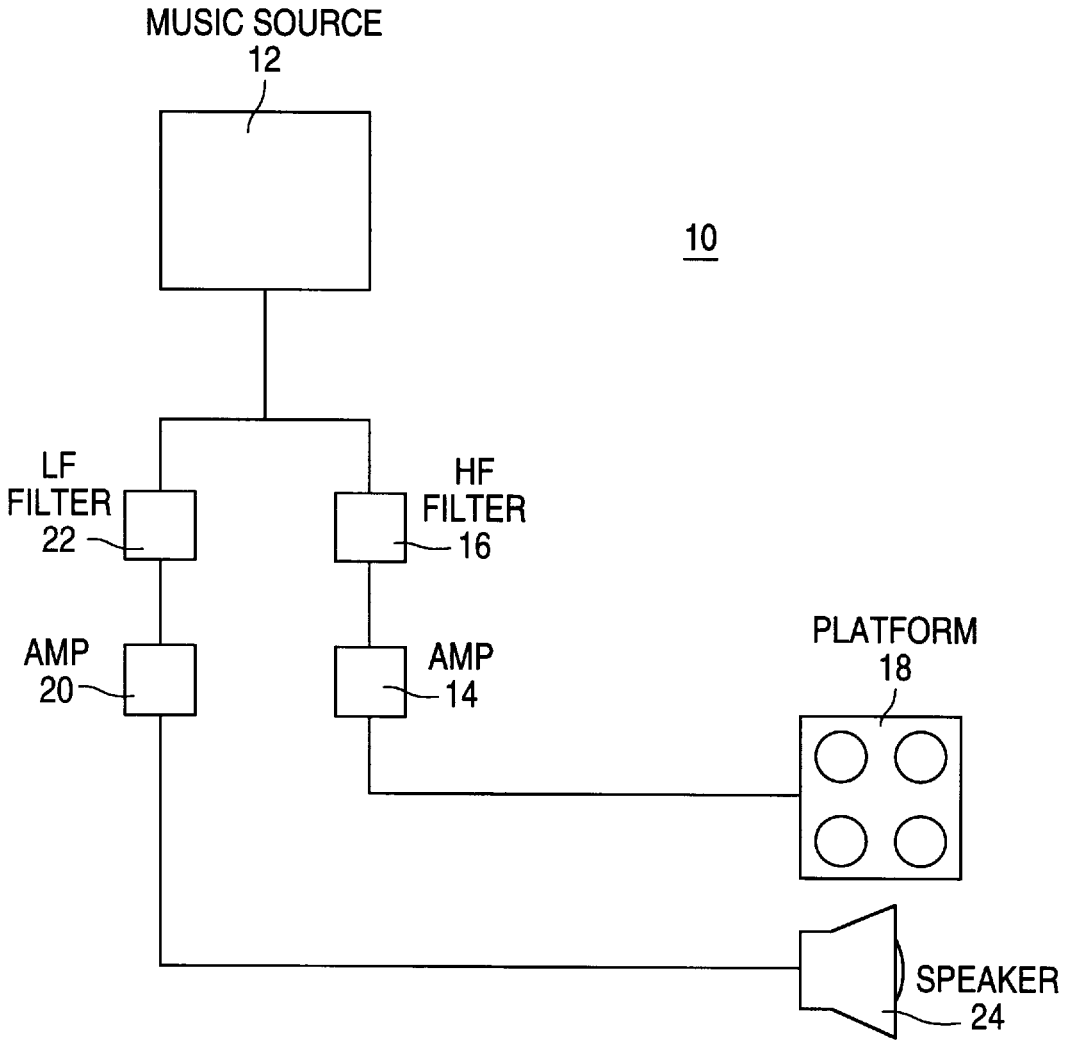
FIG. 1 shows a sound monitoring system in accordance with the present invention.

FIG. 1 shows a sound monitoring system in accordance with one embodiment of the present invention. Sound monitoring system 10 includes a music source 12, typically an audio receiver. The electronic output of music source 12 is split. One portion of the output is electronically coupled to a first audio amplifier 14 through a high frequency filter 16 that passes only sound frequencies below 100 cycles. Resonator platform 18 is electrically coupled to first audio amplifier 14.

The output of music source 12 is also electronically coupled to a second audio amplifier 20 through a low frequency filter 22 that passes only sound frequencies above 100 cycles. High frequency speaker 24 is electrically coupled to second audio amplifier 20. High frequency speaker 24 can be either a conventional open-type speaker, or can be an in-ear monitor such as a headphone.

In order to properly drive the resonator platform in accordance with the present invention, audio input to the plate from a power amplifier must be filtered to remove frequencies over 100 cycles. This may be accomplished in several ways.

In a first embodiment of a sound monitoring system in accordance with the present invention, the audio signal from a stage monitor mixing console (Yamaha model PM-2800) is routed through a low-pass filter (Ramsa model WS-SP2A Sub Processor), to a conventional power amplifier (Dynacord model P-1050), and then to the first embodiment of the resonator platform as described above. The key element in this configuration is the power amplifier, which must be capable of reproducing the frequencies of the incoming audio signal down to 20 cycles, with an amplification of at least 100 watts.

In a second embodiment of a sound monitoring system in accordance with the present invention, the audio signal was routed to a 12 V filter/class D high-current amplifier system supplied by Aura Systems, such as is typically used in car-audio systems. This embodiment was modified to run off of conventional AC power by a TRIPP LITE model PR-30 DC Power Supply. The primary advantage of this second embodiment is the relatively small size of the filter/amplifier, which can be mounted directly onto the resonator. The disadvantage of this embodiment is the weight and size of the DC Power Supply.

2. Resonator Platform

Figure 2A:
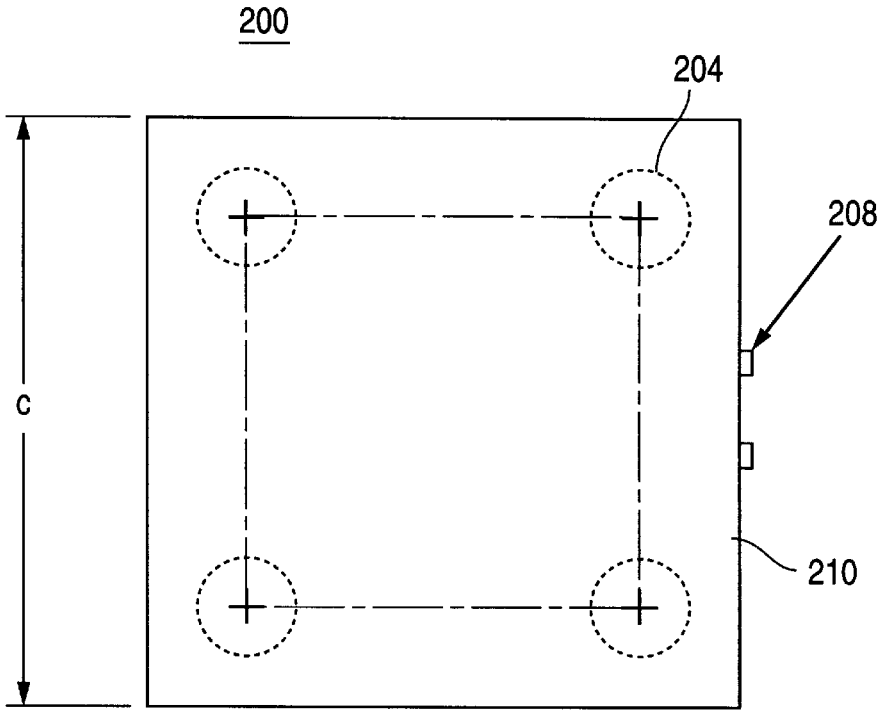
FIGS. 2A–2C show top, side, and cross-sectional views respectively, of a resonator platform in accordance with a first embodiment of the present invention.
Figure 2B:
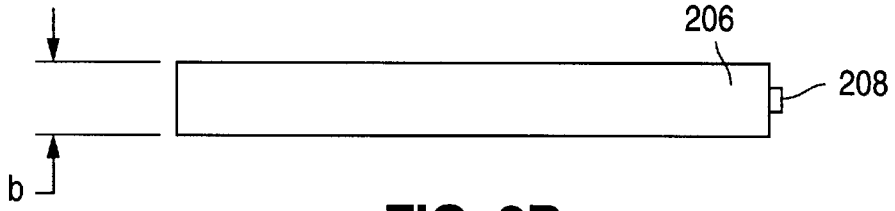
Figure 2C:
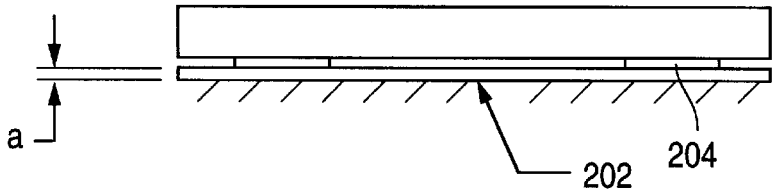

FIGS. 2A–2C show top, side, and cross-sectional views respectively, of a resonator platform in accordance with a first embodiment of the present invention. The resonator platform provides a surface of sufficient size to allow a musician to comfortably sit or stand upon the platform.

The resonator platform can be portable, and is electrically coupled to one or more electromagnetic transducers. Specifically, in this first embodiment resonator platform 200 includes a detachable square base plate 202 having thickness "a", a set of four transducers 204, side panels 206 having height "b" surrounding transducers 204, input jacks 208, and a square musician support plate 210 having width and length "c". Musician support plate 210 is in physical contact with transducers 204.

During operation of the sound monitoring system, musician support plate 210 of resonator platform 200 serves both as a diaphragm and as a physical support for the musician. Vibration of the musician support plate 210 transfers mechanical energy corresponding to low frequency sounds from electromagnetic transducers 204 directly to a user, either through the feet if the musician is standing on musician support plate 210, or through the trunk and abdomen if the musician is sitting on musician support plate 210. Advantageously, minimal detectable acoustic energy is generated by the vibrating transducer/musician support plate combination.

In one specific example of a first embodiment of a resonator platform in accordance with the present invention, the base plate is 0.5" thick, the side panels are of height 3", the square musician support plate is 24"×24", and the material used is ½" thick finished grade birch for the musician support plate, with a black ozite covering the musician support plate to enhance the cosmetic appearance.

The materials used for the musician support plate are selected based upon their capacity to vibrate in response to the transducers, and at the same time support the weight of the user. Plywood may be used, but it must have a thickness of less than ¾" so that the vibrational energy is not overly dampened by the mass of the plate. Any cosmetic covering of the plate must also be thin in order prevent absorption of vibration.

The transducers used in the resonator platform must produce sufficient vibrational energy to the musician support plate to impart a vibrational signal to the user. Specifically, LFS-8 and LFS-4 model transducers manufactured by Aura Systems of El Segundo, Calif., have been used. Alternative transducer models suitable for the present invention include Cark Tactile Transducers and RHB Transducers.

Figure 3A:
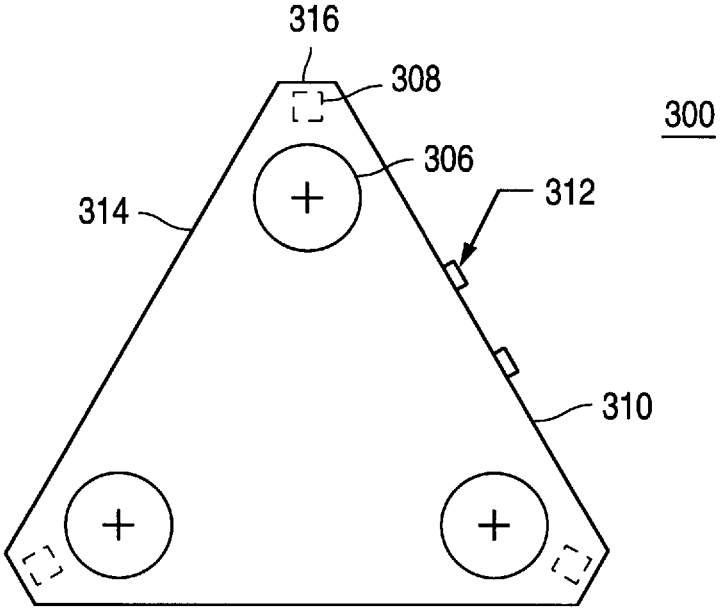
FIGS. 3A–3B show top and side views respectively, of a resonator platform in accordance with a second embodiment of the present invention.
Figure 3B:
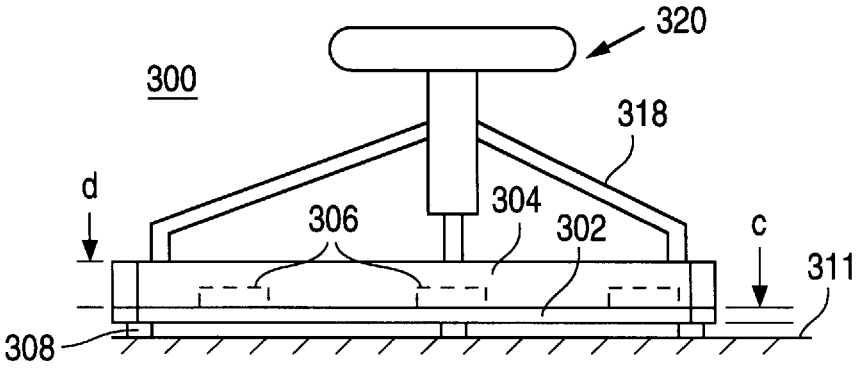

FIGS. 3A–3B show top and side views respectively, of a resonator platform 300 in accordance with a second embodiment of the present invention. Specifically, resonator platform 300 includes a substantially triangular base plate 302 having thickness c, to which is fixed a musician support plate 304 having a thickness d. A set of three transducers 306 are positioned within recesses in the musician support plate 304, and fixed to the base plate 302. Transducers 306 are fixed to base plate 302 in an inverted position, with the active, vibrating end of the transducer on the bottom, and the passive end of the transducer projecting upward. Feet 308 raise the base plate 302 off of the floor 311, allowing for slightly more resonance. Resonator platform 300 is connected to the sound system via input jacks 312.

In one example of the second embodiment of a resonator platform in accordance with the present invention, both base plate 302 and musician support plate 304 are isosceles triangles having sides 310 of length 22" that are joined by straight segments 316 of length 1.75". Base plate 302, formed from aluminum, is 0.187" thick. This thickness permits tapping and threading of machine screws to attach inverted transducers 306 to base plate 302.

Musician support plate 304, formed from plywood, is 0.75" thick. This thickness allows for wiring to be concealed between the base plate and the musician support plate, as the plywood can be routed to accommodate the wires and the input connectors. The thickness of musician support plate 304 also raises legs 318 of stool 320 above the transducers 306, so that stool 320 is not subjected to direct vibration by virtue of contact with transducers 306.

The resonator platform 300 in accordance with the second embodiment of the present invention offers a significantly shorter profile than the platform of the first embodiment, due to the fact that the musician support plate is not mounted on top of the transducers. The lower profile of the second embodiment is advantageous to users whose stools are not adjustable for height or who are concerned the stool may slip off of the musician support plate during use.

The present invention provides a number of distinct advantages over conventional sound monitoring systems and apparatuses.

First, because the musician can sense low frequency sounds by touch, monitoring sound pressure levels can be greatly reduced. This leads to a lower demand for speakers and for electrical power, and greatly increases the sound integrity of the individual instruments within the performance mix. The reduction of monitoring sound pressure levels also substantially alleviates the danger that musicians will suffer hearing loss due to excessive sound monitoring volumes.

Second, because conventional monitoring speakers have a limited ability to transmit low frequency sounds, the resonator platform in accordance with the present invention offers a greater range of frequency response. This may allow a musician to sense and appreciate tones lying outside of the normal range of audible sound.

Third, because the resonator platform need not be in direct contact with the musician's ear, the invention can be used to substantially enhance the performance of conventional in-ear monitoring systems. This is because more of the input to the in-ear monitoring system can be devoted to higher frequency notes.

While the detailed description and figures set forth above refer to a resonator platform having a square or triangular musician support plate, those skilled in the art will understand that the resonator platform and the musician support plate can assume a variety of shapes, including but not limited to circular or rectangular. Moreover, the resonator platform and its respective components may be fabricated from a range of different materials suitable for transferring a variety of vibrational energies to the user. In addition, the overall size of the resonator platform and/or the musician support plate may be increased or decreased depending upon the preferences of a particular user or the requirements of a given setting or application.

Therefore, it is intended that the following claims define the scope of the invention, and that structures within the scope of these claims and their equivalents be covered thereby.

What is claimed is:

1. A sound monitoring system comprising:

(A) receiving means for receiving an acoustic signal and transmitting an electrical driving signal in response to the acoustic signal, the receiving means including, (i) a filter for filtering audio signals of greater than 100 cycles, and (ii) an amplifier for amplifying filtered audio signals of at least 20 cycles to a power of not less than 100 Watts; and (B) resonator means for converting the electrical driving signal to a vibrational output, the resonator means including, (i) a transducer having an active end and a passive end, the transducer receiving the electrical driving signal and causing the vibrational output at the active end in response to the electrical driving signal, (ii) a base plate having a bottom side in contact with the ground and a top side in contact with the passive end of the transducer, and (iii) a musician support plate including a bottom side in contact with the active end of the transducer and a top side for supporting a musician, such that a vibrational output of the active end of the transducer is communicated to the musician support plate.

2. The sound monitoring system according to claim 1 wherein the musician support plate is formed from plywood having a thickness not greater than ¾".

3. A sound monitoring system comprising:

(A) receiving means for receiving an acoustic signal and transmitting an electrical driving signal in response to the acoustic signal, the receiving means including, (i) a filter for filtering audio signals of greater than 100 cycles, and (ii) an amplifier for amplifying filtered audio signals of at least 20 cycles to a power of not less than 100 Watts; and (B) resonator means for converting the electrical driving signal to a vibrational output, the resonator means including, (i) a transducer having an active end and a passive end, the transducer receiving the electrical driving signal and causing the vibrational output at the active end in response to the electrical driving signal, (ii) a base plate having a bottom side in contact with the ground and a top side, and (iii) a musician support plate including a bottom side in contact with the base plate and a top side for supporting a musician, the top side in contact with the active end of the transducer such that a vibrational output of the active end of the transducer is communicated to the musician support plate.

4. The sound monitoring system according to claim 3 wherein the musician support plate is formed from plywood having a thickness not greater than ¾".

5. The sound monitoring system according to claim 4 wherein the base plate is in contact with the ground via at least one foot positioned on the bottom side of the base plate.

6. A sound monitoring system comprising:

a receiver producing an electrical sound signals;

a high frequency filter for filtering out electrical sound signals above 100 cycles, the high frequency filter receiving the electrical sound signal and producing low frequency electrical sound signals;

a first amplifier receiving the low frequency electrical sound signals and producing amplified low frequency electrical sound signals;

a resonator platform, the resonator platform including a base plate, a musician support plate, and a transducer, the transducer receiving the amplified low frequency electrical sound signals and imparting vibrational energy to the musician support plate;

a low frequency filter for filtering out signals above 100 cycles, the low frequency filter receiving the electrical sound signals and producing high frequency electrical sound signals; and a second amplifier receiving the high frequency electrical sound signal and producing amplified high frequency electrical sound signals to at least one of an open air speaker and a pair of headphones.

7. A method for allowing a musician to monitor low-frequency sounds by touch, comprising the steps of:

passing an output of an electronic audio source through a high frequency filter to produce a high frequency filtered output;

amplifying the high frequency filtered output of at least 20 cycles to a power of at least 100 Watts;

transmitting the amplified high frequency filtered output to a resonator platform such that the resonator platform vibrates in response to the amplified high frequency filtered output;

passing an output of an electronic audio source through a low frequency filter to produce a low frequency filtered output;

amplifying the low frequency filtered electronic output; and transmitting the low frequency filtered electronic output to at least one of an open air speaker and a pair of headphones.

* * * * *